United States Patent [19]

Yamauchi et al.

[11] Patent Number: 4,704,655

[45] Date of Patent: Nov. 3, 1987

[54] SOLENOID DRIVE CIRCUIT

[75] Inventors: Satomi Yamauchi; Takashi Nakamura, both of Aichi, Japan

[73] Assignee: Mitsubishi Denki Kabushiki Kaisha, Tokyo, Japan

[21] Appl. No.: 910,716

[22] Filed: Sep. 24, 1986

[30] Foreign Application Priority Data

Sep. 24, 1985 [JP] Japan ..... 60-210718

[51] Int. Cl.[4] ..... H01H 47/00

[52] U.S. Cl. ..... 361/159; 361/190; 361/186

[58] Field of Search ..... 361/159, 154, 190, 189, 361/186

[56] References Cited

U.S. PATENT DOCUMENTS 3,660,730 5/1972 Mason ..... 361/190

*Primary Examiner*—L. T. Hix
*Assistant Examiner*—David M. Gray
*Attorney, Agent, or Firm*—Sughrue, Mion, Zinn, Macpeak & Seas

[57] ABSTRACT

A solenoid drive circuit in which a solenoid is intermittently driven while in a powered state. A diode and a resistor are connected from ground to opposite ends of the solenoid to quickly discharge the solenoid. However, during intermittent driving the resistor is short circuited.

6 Claims, 4 Drawing Figures

SOLENOID DRIVE CIRCUIT

BACKGROUND OF THE INVENTION

1. Field of the Invention

This invention relates to a solenoid drive circuit in which the solenoid is quickly restored.

2. Background of the Invention

When it is required to deenergize a solenoid, a diode is connected in parallel with the solenoid. In the case where the cloth pressing plate (presser foot) of a sewing machine is moved up and down by a solenoid, the solenoid is energized to move the cloth pressing plate upwardly, and it is deenergized to move the cloth pressing plate downwardly.

For instance, in a sewing operation in which a label is sewn on a piece of cloth, the cloth pressing plate must be lifted whenever it is required to change the stitching direction. That is, it is necessary to frequently move the cloth pressing plate up and down. Accordingly, in order to increase the sewing efficiency and productivity, it is desirable that the time required for moving the cloth pressing plate up and down is as short as possible. The time required for moving the cloth pressing plate upwardly is determined by the characteristic of the solenoid used. On the other hand, the time required for moving the cloth pressing plate downwardly can be decreased by connected a resistor in series to the diode which is connected in parallel to the solenoid. Therefore, the resistor is generally employed.

In a typical sewing operation, the period of time during which the cloth pressing plate is held at the lower position is longer than the period of time for which it is held at the upper position. Therefore, in order to decrease the power consumption of the solenoid, the solenoid is energized when it is required to lift the cloth pressing plate. However, if the cloth pressing plate is held at the upper position for a long period of time, for instance because of a sewing pattern, the cloth pressing plate is kept energized for a long period of time. As a result, the solenoid generates a large quantity of heat. In order to minimize the heat generation of the solenoid, a method has been employed in which, as shown in the part (a) of FIG. 1, the solenoid is continuously energized until the cloth pressing plate has been lifted, and thereafter it is intermittently energized with a period short enough to maintain the cloth pressing plate at the upper position.

If the solenoid is energized intermittently as described above, current flows in the series circuit of the resistor and the diode which is connected in parallel with the solenoid whenever the energization of the solenoid is turned off, and therefore the resistor generates a large quantity of heat. Accordingly, the resistor must be large in power capacity, and accordingly large in size. Therefore, the resistor presents little freedom in where it can be installed, and it is not economical.

SUMMARY OF THE INVENTION

Accordingly, an object of this invention is to eliminate the above-described difficulties. More specifically, an object of the invention is to provide a solenoid drive circuit in which the resistor has a small average current rating and can be proportionately smaller.

The foregoing object of the invention has been achieved by the provision of a solenoid drive circuit in which the resistor connected in series to the diode is short-circuited while the solenoid is driven intermittently.

Figure 2:
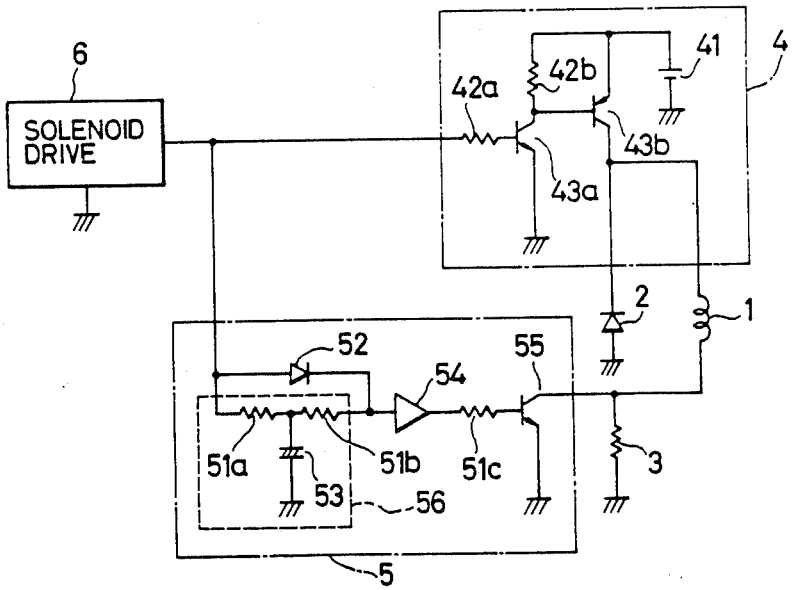

The parts (a) through (c) of FIG. 2 are time charts indicating the waveforms of signals at circuit points.

DETAILED DESCRIPTION OF THE PREFERRED EMBODIMENTS

Figure 1:
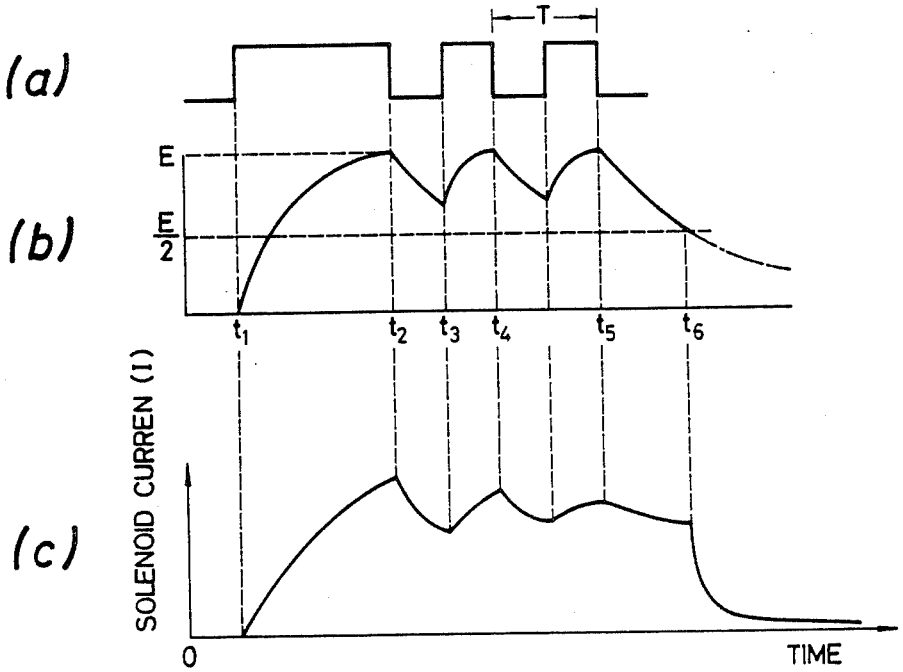
FIG. 1 is a circuit diagram showing one embodiment of this invention.

FIG. 1 is a circuit diagram showing a solenoid drive circuit, which is one embodiment of the invention. In FIG. 1 is shown a solenoid 1, a diode 4 in parallel with the solenoid 1, and a resistor 3 connecting the solenoid 1 to ground. A solenoid drive source connecting means 4 connects a solenoid drive source 6 to conduct current between the upper connection point between the parallel connected solenoid 1 and the diode 2 and lower grounded connection point between the diode 2 and the resistor 3. The connection is made in synchronization with the repetitive period of an intermittent signal from the solenoid drive source 6. A switching circuit 5 short-circuits the resistor 3 during the repetitive period of the intermittent signal from the solenoid drive source.

The drive source connecting means 4 comprises a power source 41, resistors 42*a* and 42*b*, and transistors 43*a* and 43*b*. The switching circuit 5 includes resistors 51*a* through 51*c*, a diode 52, a capacitor 53, an IC gate (buffer) 54, and a transistor 55. The resistors 51*a* and 51*b* and the capacitor 53 form an integrating circuit 56.

Let us consider the case where an intermittent signal as shown in the part (a) of FIG. 2 is applied to the solenoid drive circuit thus arranged. In this case, as shown in the part (b) of FIG. 2, charging of the capacitor 53 starts at the time instant $t_1$, and the voltage of the capacitor 53 reaches a value of about E at the time instant $t_2$. The value E is primarily determined by the solenoid drive source 6. At the same time instant $t_2$, discharging of the capacitor 53 starts. The threshold voltage of the IC gate 54 is about E/2. Therefore, the transistor 55 can be maintained conductive (on) at the time instant $t_3$ by satisfying the following expression (1):

$$E\cdot\exp(-T/2R_aC)>E/2 \quad (1)$$

Accordingly, $$R_aC>2\cdot\log_e 2 \quad (2)$$

On the other hand, the terminal voltage $E_c$ of the capacitor 53 for the period between $t_3$ to $t_4$ can be represented by the following expression (3):

$$E_c=E_1+(E-V_D-E_1)(1\text{-}\exp((t-t_3)/R_bC) \quad (3)$$

where $E_l$ is the terminal voltage of the capacitor 53 at the time instant $t_3$, $V_D$ is the forward voltage of the diode 52, and $R_b$ is the resistance of the resistor 51*b*, which is smaller than $R_a$ ($R_a>R_b$).

According to expressions (1) and (3), the resistance $R_b$ of the resistor 51*b* should satisfy $R_a>R_b$ so that no difficulty is caused even if a voltage decrease occurs owing to the forward voltage of the diode. In addition, the lower limit value should be larger than the value at which the IC gate 54 causes latch-up.

When the voltage as shown in the part (a) of FIG. 2 is applied to the solenoid drive circuit thus organized, the transistors 43*a* and 43*b* in the drive source connecting means are rendered conductive (on) and nonconductive (off) according to the control signals applied to it. On the other hand, the period of the intermittent signal and the time constant of the integrating circuit are set to values high enough to maintain the cloth presser lifted. Accordingly, the cloth presser is maintained lifted but the generation of heat by the solenoid 1 is reduced. While the intermittent signal is being supplied to the circuit, the terminal voltage of the capacitor 53 is higher than the threshold voltage of the IC gate 54, and therefore the transistor 55 is conductive. Therefore, the resistor 3 is short-circuited by the transistor 55, which prevents the generation of heat in the resistor 3 during the intermittent signal application. This heat generation was one of the drawbacks accompanying the conventional method.

At the time instant $t_6$ after the end of intermittent signal, the input voltage of the IC gate 54 becomes lower than the threshold value, as a result of which the transistor 55 is rendered non-conductive (off) and the short-circuiting of the resistor 3 is eliminated. Therefore, the terminal current of the solenoid 1 changes as shown in part (c) of FIG. 2. That is, the terminal voltage changes according to the characteristic of the diode 2 until the time instant $t_6$. However, it is abruptly decreased as indicated by the solid line after the time instant $t_6$ because the diode 2 is connected in series to the resistor 3; that is, the cloth presser is quickly moved down. In part (c) of FIG. 2, the one-dot chain line indicates the characteristic that would occur if only the diode 2 were connected to the solenoid.

As was described above, in the solenoid drive circuit of the invention, during the repetitive period of the control signal, the variation of the control signal is absorbed by the integrating circuit, and the solenoid energy absorbing resistor is maintained short-circuited. Therefore, the generation of heat by the resistor during the operation of the solenoid is prevented. Accordingly the solenoid energy absorbing resistor may be one which is small in power capacity. That is, the resistor is small in size and accordingly high in the degree of installation freedom, and is economical.

What is claimed is:

1. A solenoid drive circuit, comprising:

a diode;

a series circuit of a solenoid and a resistor, which is connected in parallel with said diode;

a drive power source for supplying an intermittent signal with a repetitive period;

a drive power source connecting means for connecting said drive power source between a connecting point of said diode and said solenoid and a connecting point of said diode and said resistor in synchronization with the repetitive period of said intermittent signal;

means for bypassing said resistor; and a switching circuit in which said intermittent signal is applied to an integrating circuit of said switching circuit, the output of said switching circuit being utilized to control said bypassing means.

2. A solenoid drive circuit as recited in claim 1, wherein said bypassing means comprises switching means connected in parallel with said resistor and controlled by said output of said switching circuit whereby said resistor can be controllably short-circuited.

3. A solenoid drive circuit as recited in claim 2, wherein a time constant of said integrating circuit is long enough to maintain said switching means in a conducting state during a duration of said repetitive period.

4. A solenoid drive circuit as recited in claim 3, wherein said integrating circuit has a fall time longer than a rise time.

5. A solenoid drive circuit as recited in claim 4, wherein said switching circuit controls said switching means to be non-conductive means after a predetermined time following an end of said intermittent signal.

6. A solenoid drive circuit as recited in claim 5, wherein said integrating circuit comprises a series circuit of a first resistor receiving said intermittent signal and a second resistor smaller than said first resistor, a second diode connected in parallel to said series circuit and a capacitor connected between a reference potential and a connecting point of said first and second resistors.

* * * * *